US010542814B2

(12) United States Patent
Kelders et al.

(10) Patent No.: US 10,542,814 B2
(45) Date of Patent: Jan. 28, 2020

(54) LIP BALM APPLICATOR AND METHOD FOR MANUFACTURING A LIP BALM APPLICATOR

(71) Applicant: AIROSOLUTIONS NV, Heist-op-den-Berg (BE)

(72) Inventors: Quint Kelders, Heist-op-den-Berg (BE); Mark Brouwer, Heist-op-den-Berg (BE); Mervin Cleij, Heist-op-den-Berg (BE)

(73) Assignee: AIROSOLUTIONS NV, Heist-op-den-Berg (BE)

( * ) Notice: Subject to any disclaimer, the term of this patent is extended or adjusted under 35 U.S.C. 154(b) by 0 days.

(21) Appl. No.: 16/060,457

(22) PCT Filed: Dec. 10, 2016

(86) PCT No.: PCT/IB2016/057519

§ 371 (c)(1),
(2) Date: Jun. 8, 2018

(87) PCT Pub. No.: WO2017/098480

PCT Pub. Date: Jun. 15, 2017

(65) Prior Publication Data

US 2018/0368555 A1 Dec. 27, 2018

(30) Foreign Application Priority Data

Dec. 11, 2015 (CH) ..... 1811/15

(51) Int. Cl.
*A45D 40/16* (2006.01)
*A45D 40/00* (2006.01)

(52) U.S. Cl.
CPC ..... *A45D 40/16* (2013.01); *A45D 40/00* (2013.01); *A45D 2040/0012* (2013.01); *A45D 2040/0062* (2013.01)

(58) Field of Classification Search
CPC .... A45D 40/16; A45D 40/00; A45D 40/0087; A45D 40/20; A45D 2040/0012;
(Continued)

(56) References Cited

U.S. PATENT DOCUMENTS 5,884,637 A * 3/1999 Joulia ..... A45D 33/00 132/318
8,651,308 B1 2/2014 Sung
(Continued)

FOREIGN PATENT DOCUMENTS

FR 2 563 711 A1 11/1985
JP 2004-321410 A 11/2004

OTHER PUBLICATIONS

International Search Report for International Application No. PCT/IB2016/057519 dated Feb. 7, 2017.
(Continued)

*Primary Examiner* — David J Walczak
(74) *Attorney, Agent, or Firm* — Lathrop Gage LLP

(57) ABSTRACT

A new lip balm applicator comprises an upper portion and a lower portion that are interengageably connected to one another to define the applicator, and a support assembly for supporting a solidified lip balm material within the applicator. The support assembly comprises supporting ribs formed on an inner surface of the lower portion and a lower opening having a closing lid, whereby the solidified lip balm material circumvents at least part of the supporting ribs. A novel method for manufacturing the lip balm applicator comprises interengaging the upper and lower portions of the lip balm applicator and pouring a liquefied lip balm material into the lower opening until at least part of the projecting supporting ribs are covered by the liquefied balm material and solidified.

10 Claims, 4 Drawing Sheets

(58) Field of Classification Search
CPC ..... A45D 2040/0062; A45D 2040/00; A45D 2040/0025; A45D 2040/20; A45D 2200/005
See application file for complete search history.

(56) References Cited

U.S. PATENT DOCUMENTS

| | | | | |
|---|---|---|---|---|
| 8,888,391 | B2 | 11/2014 | Teller et al. | |
| 9,924,776 | B2 * | 3/2018 | Schlatter | A45D 33/02 |
| 10,039,366 | B1 * | 8/2018 | Facer | A45D 40/24 |
| 10,112,751 | B2 * | 10/2018 | Teller | B65D 51/245 |
| 2015/0251052 | A1 | 9/2015 | Zaker | |

OTHER PUBLICATIONS

Written Opinion for International Application No. PCT/IB2016/057519 dated Feb. 7, 2017.

* cited by examiner

LIP BALM APPLICATOR AND METHOD FOR MANUFACTURING A LIP BALM APPLICATOR

CROSS-REFERENCE TO RELATED APPLICATIONS

This application is a National Stage application of International Patent Application No. PCT/IB2016/057519, filed on Dec. 10, 2016, which claims priority to Swiss Patent Application No. CH 01811/15, filed on Dec. 11, 2015, each of which is hereby incorporated by reference in its entirety.

TECHNICAL FIELD

The invention pertains to a lip balm applicator and a method for manufacturing a lip balm applicator.

BACKGROUND OF THE INVENTION

Such a lip balm applicator is described in U.S. Pat. No. 8,888,391, which has a lip balm composition and comprises a receptacle with an upper portion and a lower portion. The portions are separable by interengablbe threads or other means for frictionally connecting the upper and lower portions. The outer surface of the receptacle includes a depression which is partly formed on the upper portion and partly on the lower portion. The lip balm is mounted in the lower portion on a support platform. The support platform is a wheel having an outer rim and includes a plurality of spokes which extend from the outer rim and terminate at a hub in the middle of the support platform. The upper portion has a spherical or arcuate form.

The lip balm is manufactured from the lip balm material using a hot pour process. The lip balm ingredients are combined and heated in a liquefied phase and poured into the final consumer packaging, which is here the receptacle. In preparation of the hot pour process, the support platform is assembled with the upper portion and inverted such that the support platform is level and vertical with regard to the upper portion. The heated and liquefied phase is poured into the upper portion and retained therein. After pouring the liquefied phase is cooled or allowed to cool. The spokes of the wheel provide surface onto which the solidified lip balm material can adhere. Upon sufficient solidification of the lip balm material, the lower portion is inserted onto the assembled and filled upper portion and support platform.

The lip balm material of above mentioned applicator has a flat lower surface with is lying on the support platform, especially on the spokes of the wheel. If the lip balm material is adhering to the upper portion after solidification, the lower surface of the lip balm may sometimes slide over the support platform or the spokes of the wheel, so that the lip balm sticks to the upper portion and the applicator cannot be used anymore. On the other hand, after pouring the heated and liquefied phase it must be cooled to solidification before the lower portion can be assembled to the upper portion, which is logistically quite inconvenient.

SUMMARY OF THE INVENTION

It is the object of the present invention to provide an improved lip balm applicator and an improved method for manufacturing such a lip balm applicator which does not have the disadvantages of the prior art.

This object is accomplished by a lip balm applicator and a method for manufacturing a lip balm applicator.

The lip balm applicator according to the present invention comprises an upper portion and a lower portion, which have interengageable connecting means and a support for supporting a solidified lip balm material, wherein the lower portion comprises supporting ribs formed on the inner surface of the lower portion and a lower opening having a closing lid and wherein the solidified lip balm material is circumventing at least part of the supporting ribs.

In a preferred embodiment of the lip balm applicator the supporting ribs are formed essentially in a parallel direction to the central axis of the lower portion.

In another preferred embodiment of the lip balm applicator two or more supporting ribs are connected in the upper region of the lower portion by a bridging part.

In a further embodiment of the lip balm applicator two adjacent supporting ribs are connected in pairs in by an arcuate bridge.

In another preferred embodiment of the lip balm applicator the supporting ribs are interconnected by a ring.

In a further advantageous embodiment of the lip balm applicator the upper portion comprises an outer spherical or ellipsoid part which is connected to an inner spherical or ellipsoid part that forms the mould and cover of the lip balm material.

In another advantageous embodiment of the lip balm applicator the outer spherical or ellipsoid part is connected to the inner spherical or ellipsoid part by a snap-fit connection.

In a further embodiment of the lip balm applicator the outer and inner spherical or ellipsoid parts are spaced apart by a gap.

The method for manufacturing a lip balm applicator which comprises an upper portion and a lower portion which have interengageable connecting means and a support for supporting a solidified balm material according to the invention comprises the following steps: supporting ribs are formed on the inner surface of the lower portion and the lower portion is provided with a lower opening, which can be closed by a closing lid, the upper portion and the lower portion are interengaged by the connecting means, the assembled lip balm applicator is then turned upside down, thereafter a liquified lip balm material is poured into the opening until at least part of the supporting ribs are covered by the liquified balm material, and then the lip balm material is allowed to cool down in order to solidify and the opening is closed by the closing lid.

In a further advantageous step for manufacturing the lip balm applicator two or more supporting ribs are formed to be connected in the upper region of the lower portion by a bridging part and at least the bridging part is covered by the liquified lip balm material.

Further advantages of the present invention can be seen from the description below.

BRIEF DESCRIPTION OF THE FIGURES

In the following, the invention is described in greater detail, by way of example, with reference to the accompanying drawings.

DETAILED DESCRIPTION OF PREFERRED EMBODIMENTS

In the figures, the same reference numbers are used for the same elements.

Figure 1:
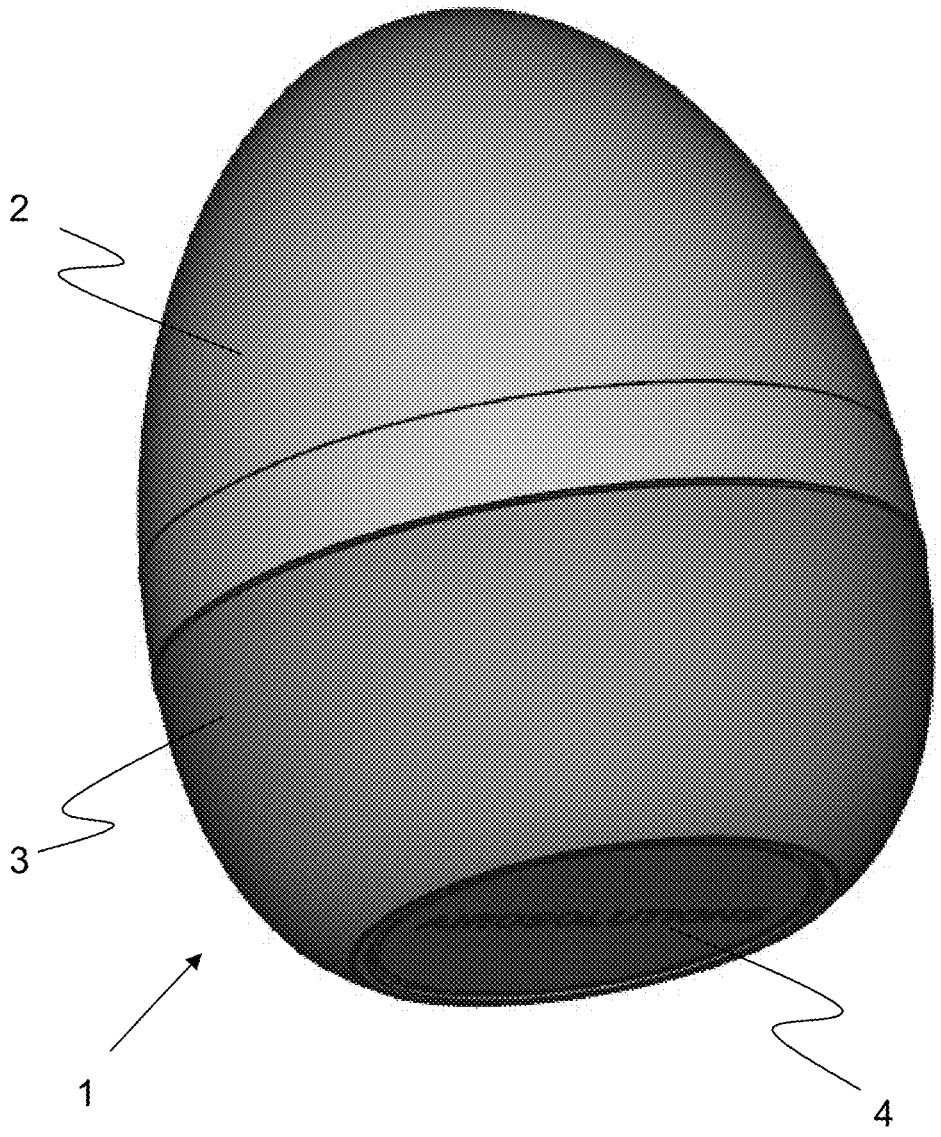
FIG. 1 shows a lip balm applicator in perspective view in closed condition.

FIG. 1 shows a lip balm applicator 1 with an upper portion 2, a lower portion 3 and a closure lid 4. The lip balm applicator 1 has a rotational symmetrical shape. As can be seen from this figure, the upper portion 2 has a half-ellipsoid shape, like the top of an egg. The lower portion 3 has partly a frusto-spherical shape which is cut-off at the lower end.

Figure 2:
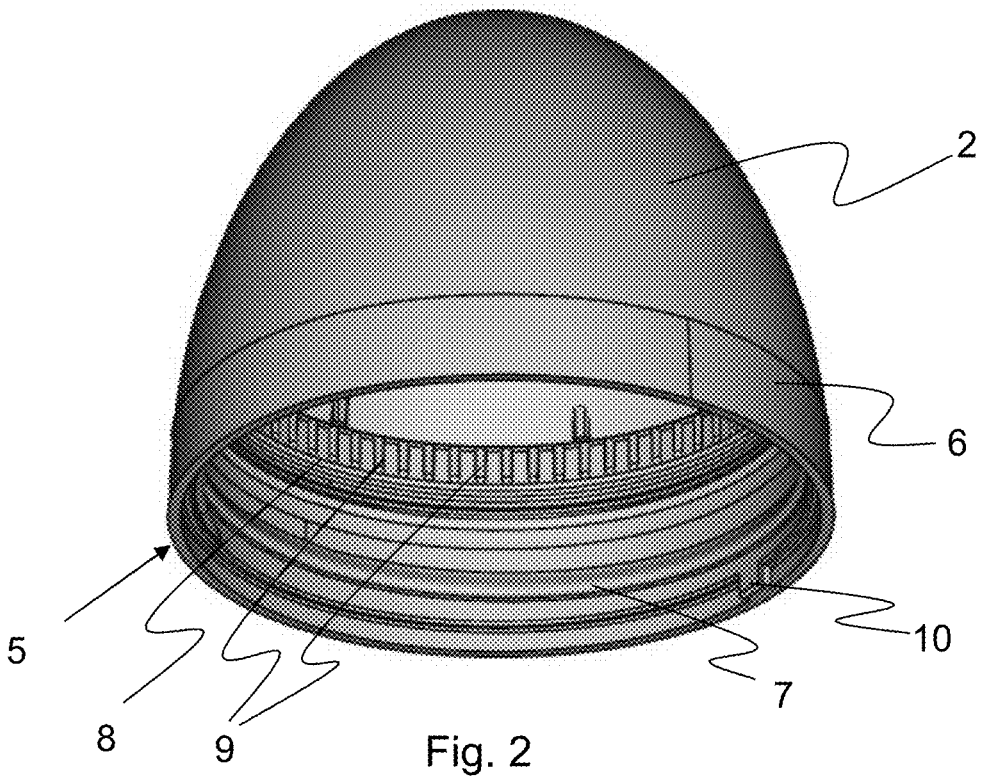
FIG. 2 shows the upper portion of the lip balm applicator.

In FIG. 2 the upper portion 2 is depicted in perspective view from below. At the lower end 5 a ring 6 is provided with an inner thread 7 and adjacent to the ring 6 a ring-shaped connecting means 8 with a plurality of inner protrusions 9 is provided. The inner protrusions 9 are provided at a distance to each other by the width of an individual protrusion. The inner thread 7 has an incision 10, which is used for a click connection with the lower portion 3 (see below).

Figure 3:
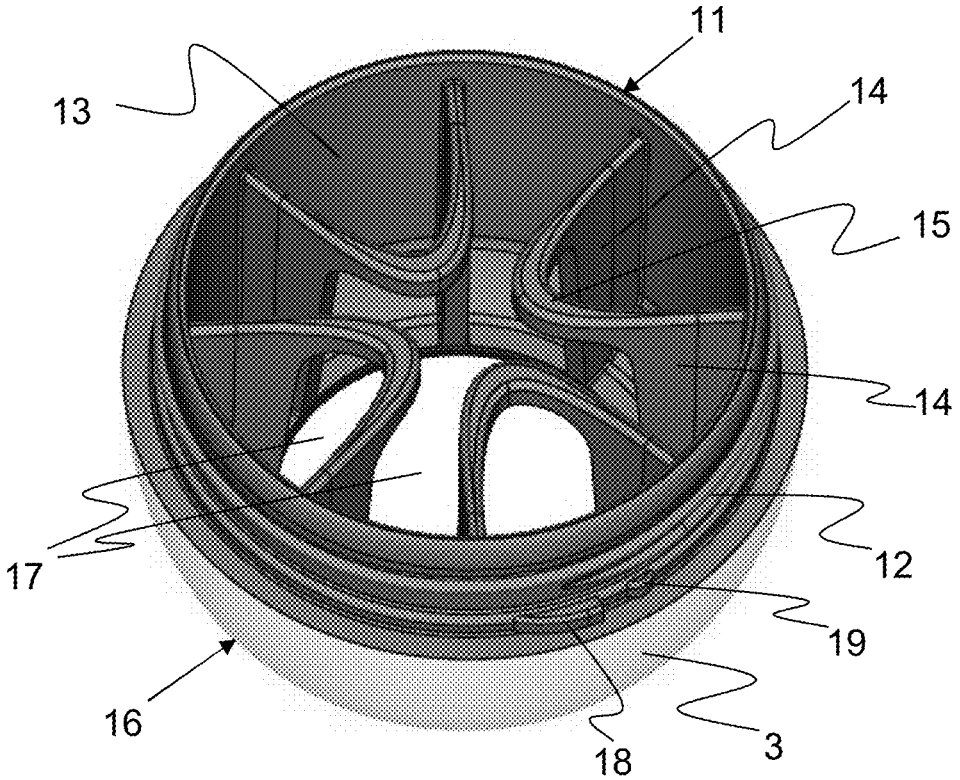
FIG. 3 shows the lower portion of the lip balm applicator.

In FIG. 3 the lower portion 3 is shown in a perspective view from above. At the outer upper end 11 an outer thread 12 is provided, which is commensurate to the inner thread 7. Thus, the inner thread 7 and the outer thread 12 provided an interengageable connecting means for the upper portion 2 and the lower portion 3. At the inner wall 13 of the lower portion 3 supporting ribs 14 are provided, which are projecting to the inside and are directed parallel to the central axis A of the lip balm applicator 1 and thus of the lower portion 3 (see FIG. 7A). Adjacent projecting ribs 14 in pairs are connected at the upper end 11 by a curved narrow bridge 15. There are four pair of bridged projecting ribs 14 which face each other. The lower end 16 of the lower portion 3 has a circular opening 17. All projecting ribs 14 may also be interconnected by a ring or the like. The thread 12 shows a wedge-shaped stop element 18 and a protruding click element 19, which engages with the incision 10 of the upper portion 2, when the upper portion 2 and the lower portion 3 are interengaged by a screwing action. The upper portion 2 and the lower portion 3 can easily be disengaged by a counter-screwing action whereas there is a little friction between the protruding click element 19 and the incision 10.

Figure 4:
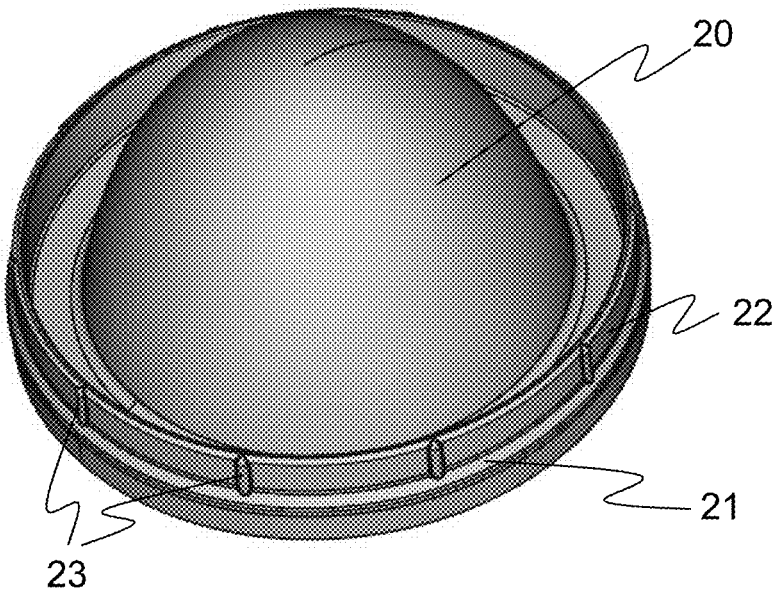
FIG. 4 shows a filling cup in a perspective view from above.
Figure 5:
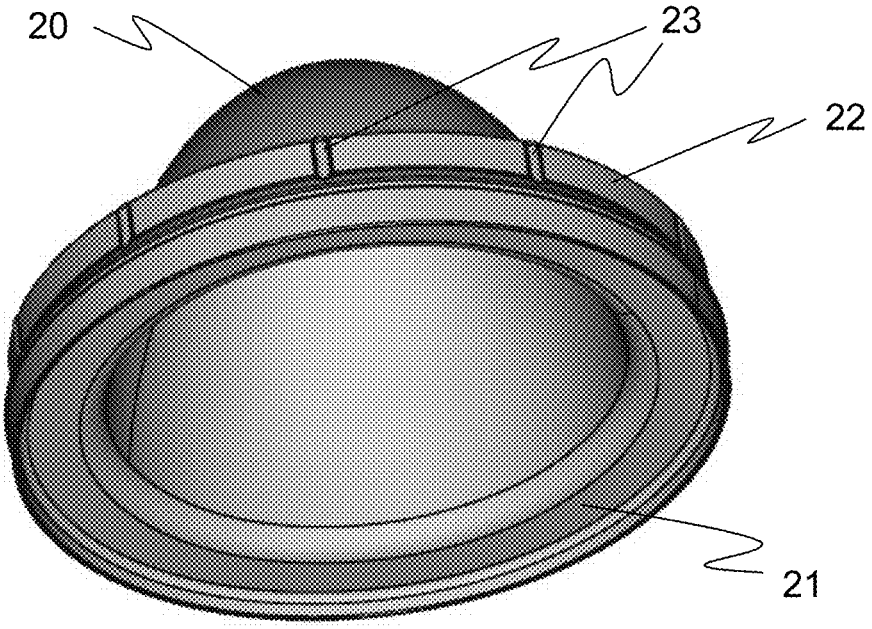
FIG. 5 shows the filling cup in a perspective view from below.

FIGS. 4 and 5 show a filling cup 20 in perspective view from above and from below respectively. The filling cup 20 has an ellipsoidal shape and is provided with a broader outer rim 21, on which an upper ring 22 with outer protrusions 23, which are distributed over the ring 22 with a larger width of about ten times the width of an individual protrusion 23. As immediately can be seen, the protrusions 9 and 23 have the same shape and thus the same width.

Figure 6:
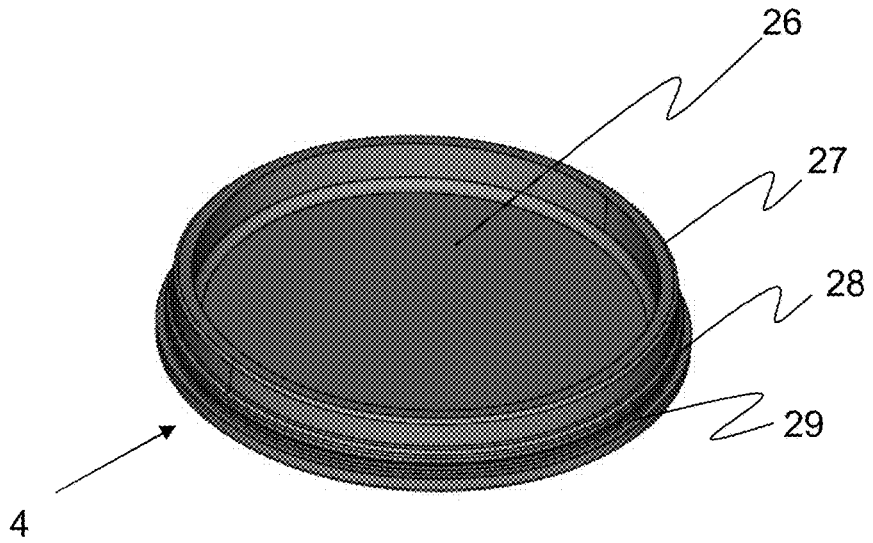
FIG. 6 shows the closure part of the lip balm applicator.

FIG. 6 shows the closure lid 4, which is shaped as a flat circular disc 26 with an upper ring-shaped rim 27, which is provided with an inner step 28 towards the outer edge 29 of the disc 26. This closure lid 4 is provided for closing the opening 17 of the lower portion 3.

Figure 7A:
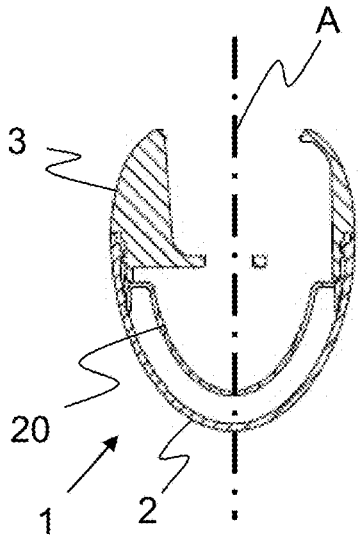
FIGS. 7A-7C show three cross-sections through the lip balm applicator in three different production stages.
Figure 7B:
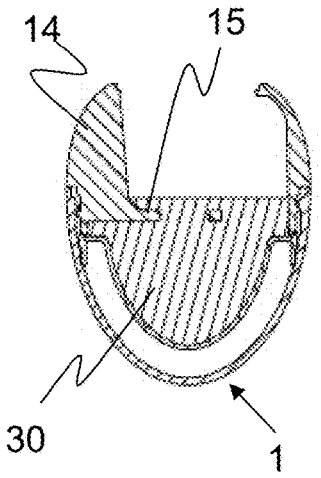
Figure 7C:
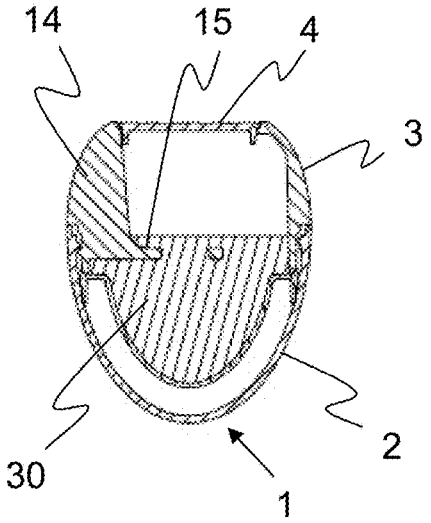

In FIGS. 7A to 7C a cross-section of the lip balm applicator 1 are shown. FIG. 7A shows the central axis A of the lip balm applicator 1. In FIG. 7A the lip balm applicator 1 is empty, in FIG. 7B the lip balm applicator 1 is filled with a lip balm 30 which partly circumvents the projecting ribs 14 and the curved narrow bridge 15. In FIG. 7C the lip balm applicator 1 closed with the closure lid 4 is ready for use.

In order to provide a lip balm applicator 1 ready for use, the upper portion 2, the filling cup 20 and the lower cup 3 are assembled, i.e. the filling cup 20 is snap fitted into the upper portion 2 by interengaging the outer protrusions 23 with the inner protrusions 9, i.e. one outer protrusion 23 is pinched between two adjacent inner protrusions 9. In this manner the filling cup 20 is part of the upper portion 2, whereas the filling cup 20 and the upper portion 2 are spaced apart by a gap. Thereupon, the upper portion 2 is interengaged with the lower portion 3 by the inner thread 7 and and the outer thread 12. The present invention is not limited in this regard, as any other locking mechanism as bayonet connection or the like can be used to frictionally connect the upper portion 2 with the lower portion 3.

The assembled lip balm applicator 1 with the open opening 17 is turned upside down and filled with hot liquified lip balm material 30 until at least the curved narrow bridges 15 of the lower portion 3 are covered by the liquified lip balm. After that the lip balm material 30 is allowed to cool down in order to solidify. The open lip balm applicator 1 is then closed by the closure lid 4.

While the present invention has been illustrated and described with respect to a particular embodiment thereof, it should be appreciated by those of ordinary skill in the art that various modifications to this invention may be made without departing from the spirit and scope of the present.

What is claimed is:

1. A lip balm applicator comprising an upper portion and a lower portion, which portions have interengageable connecting means for connecting the upper and lower portions, a solidified lip balm material, and a support assembly for supporting the solidified lip balm material within the upper portion of the applicator, wherein the support assembly comprises supporting ribs formed on an inner surface of the lower portion, which provide support for the solidified lip balm material, whereas the supporting ribs are formed projecting from the inner surface of the lower portion essentially in a direction parallel to a central axis of the lower portion, and the lower portion comprises a lower opening having a closing lid, and whereby the solidified lip balm material circumvents at least part of the projecting supporting ribs.

2. The lip balm applicator according to claim 1, wherein two or more of the supporting ribs are connected in an upper region of the lower portion by a bridging part.

3. The lip balm applicator according to claim 2, wherein the bridging part comprises a ring interconnecting the two or more supporting ribs.

4. The lip balm applicator according to claim 1, wherein the supporting ribs are connected in adjacent pairs by an arcuate bridge.

5. The lip balm applicator according to claim 1, wherein the upper portion comprises an outer spherical or ellipsoid part which is connected to an inner spherical or ellipsoid part that forms a mould and cover for the solidified lip balm material.

6. The lip balm applicator according to claim 5, wherein the outer spherical or ellipsoid part is connected to the inner spherical or ellipsoid part by a snap-fit connection.

7. The lip balm applicator according to claim 5, wherein the outer and inner spherical or ellipsoid parts are spaced apart by a gap.

8. A method for manufacturing a lip balm applicator comprising an upper portion and a lower portion, which portions have interengageable connecting means for connecting the upper and lower portions, and a support assembly for supporting a solidified balm material within the upper portion of the applicator, wherein the method comprises following steps:

forming on an inner surface of the lower portion supporting ribs projecting from the inner surface essentially in a direction parallel to a central axis of the lower portion, which supporting ribs define the support assembly;

providing the lower portion with a lower opening, which can be closed by a closing lid;

assembling the upper portion and the lower portion by interengaging the connecting means;

turning the assembled lip balm applicator upside down and thereafter pouring a liquified lip balm material into the opening until at least part of the projecting supporting ribs are covered by the liquified balm material; and then allowing the lip balm material to cool down in order to solidify; and closing the opening by the closing lid.

9. The method according to claim 8, wherein two or more of the supporting ribs are formed to be connected in an upper region of the lower portion by a bridging part wherein at least the bridging part is covered by the liquified lip balm material.

10. The method according to claim 9, wherein the bridging part comprises a ring interconnecting the supporting ribs.

* * * * *